US005878762A

United States Patent [19]

Huang

[11] Patent Number: 5,878,762

[45] Date of Patent: Mar. 9, 1999

[54] COUPLING DEVICE FOR COLLAPSIBLE SUNSHADE UMBRELLA

[76] Inventor: Hsi-Chin Huang, No. 181, Wentzu Rd., Hsienhsi Hsiang, Changhua Hsien, Taiwan

[21] Appl. No.: 114,476

[22] Filed: Jul. 13, 1998

[51] Int. Cl.[6] ..... A45B 3/00

[52] U.S. Cl. ..... 135/16; 248/121; 248/122.1

[58] Field of Search ..... 135/16, 66, 19, 135/15.1, 69; 220/23.4, 475; 224/915; 248/121, 292.12, 224.7, 122.1

[56] References Cited

U.S. PATENT DOCUMENTS

| | | |
|---|---|---|
| 2,039,805 | 5/1936 | Knight . |
| 2,822,143 | 2/1958 | Johansen . |
| 2,911,178 | 11/1959 | Joffe . |
| 3,148,851 | 9/1964 | Condon . |
| 3,434,484 | 3/1969 | Dilullo . |
| 3,765,434 | 10/1973 | Riggs . |
| 5,123,619 | 6/1992 | Tomlinson et al. . |
| 5,161,561 | 11/1992 | Jamieson . |
| 5,396,915 | 3/1995 | Bomar . |
| 5,669,536 | 9/1997 | Wang . |
| 5,808,217 | 9/1998 | Liao . |

*Primary Examiner*—Lanna Mai
*Attorney, Agent, or Firm*—Sixbey, Friedman, Leedom & Ferguson, PC; Stuart J. Friedman

[57] ABSTRACT

A coupling device for a collapsible sunshade umbrella includes a coupling base including a supporting column having a first end portion and a second end portion containing an insertion socket therein, two juxtaposed extension ears each extending outward from the outer wall of the supporting column and each formed with a plurality of locking ribs, and a pivot base including a rotary block rotatably mounted between the two extension ears and having two sides each containing a plurality of locking indents each receiving one of the plurality of locking ribs of each of the two extension ears, and a supporting tube fixedly mounted on the rotary block.

11 Claims, 8 Drawing Sheets

COUPLING DEVICE FOR COLLAPSIBLE SUNSHADE UMBRELLA

FIELD OF THE INVENTION

The present invention relates to a coupling device, and more particularly to a coupling device for a collapsible sunshade umbrella.

BACKGROUND OF THE INVENTION

A conventional sunshade umbrella is shown in FIG. 8, of which there will be a complete explanation in the detailed description of the preferred embodiments. The present invention has arisen to mitigate and/or obviate the disadvantage of the conventional sunshade umbrella.

SUMMARY OF THE INVENTION

In accordance with one aspect of the present invention, there is provided a coupling device for a collapsible sunshade umbrella comprising a coupling base comprising a supporting column including a first end portion and a second end portion containing an insertion socket therein, and two juxtaposed extension ears each extending outward from the outer wall of the supporting column and each formed with a plurality of locking ribs, and a pivot base comprising a rotary block rotatably mounted between the two extension ears and including two sides each containing a plurality of locking indents each receiving one of the plurality of locking ribs of each of the two extension ears, and a supporting tube fixedly mounted on the rotary block.

Further benefits and advantages of the present invention will become apparent after a careful reading of the detailed description with appropriate reference to the accompanying drawings.

DETAILED DESCRIPTION OF THE PREFERRED EMBODIMENTS

Figure 8:
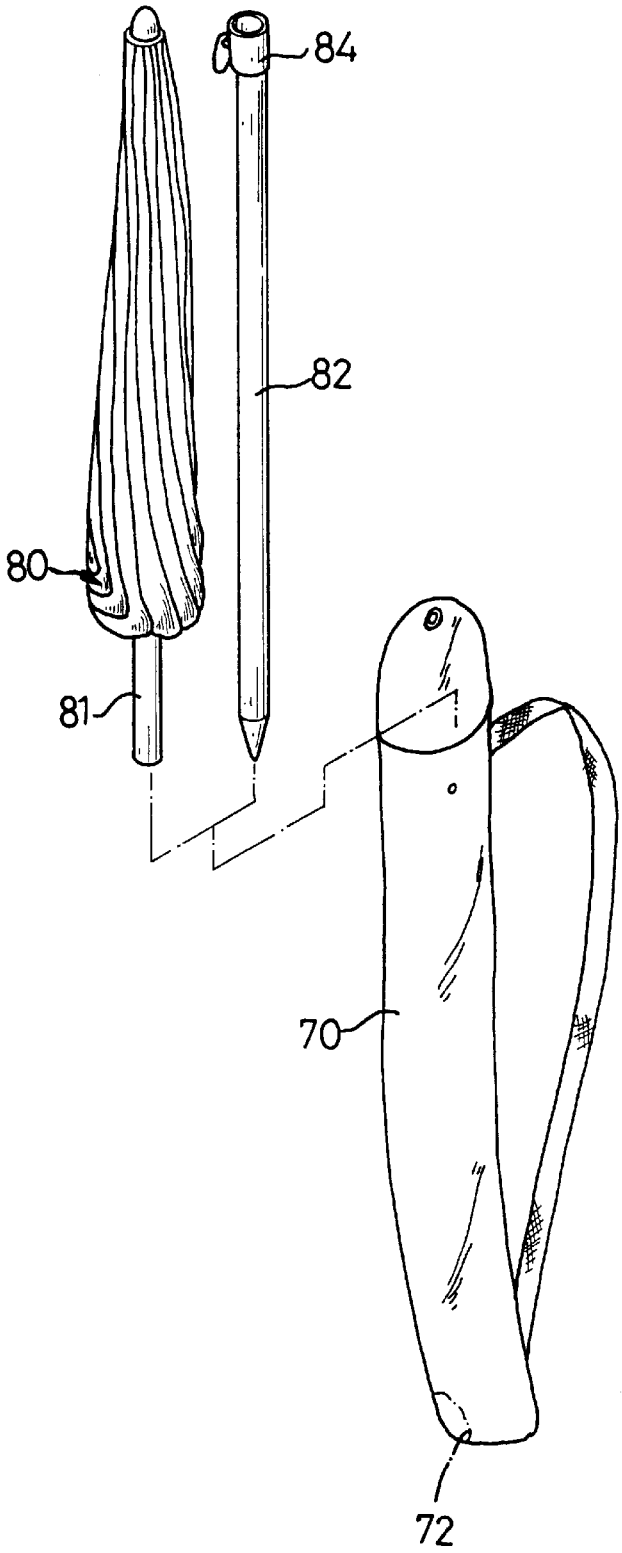
FIG. 8 PRIOR ART
FIG. 8 is an exploded view of a conventional sunshade umbrella in accordance with the prior art.

For a better understanding of the present invention, reference is made to FIG. 8 illustrating a conventional sunshade umbrella 80 in accordance with the prior art.

The conventional sunshade umbrella 80 comprises a shank 81 fixed to a fastening tube 84 of a supporting post 82 which can be inserted into the sand at a beach. The sunshade umbrella 80 can be collapsed by means of separating the shank 81 from the supporting post 82 which can both be put into a bag 70. By such an arrangement, the shank 81 and the supporting post 82 tend to drop from the bag 70 separately when the bag 70 is torn to form a hole 72. In addition, the shank 81 is fixed on the supporting post 82 in use such that the inclined angle of the sunshade umbrella 80 cannot be adjusted, thereby easily limiting the versatility of the sunshade umbrella 80.

Referring now to FIGS. 1–4, a coupling device in accordance with the present invention can be adapted to suit a collapsible sunshade umbrella 60 which comprises a shank 61 and a supporting post 62. The coupling device comprises a coupling base 20 comprising a supporting column 24 including a first end portion and a second end portion containing an insertion socket 25 therein for receiving the supporting post 62 of the sunshade umbrella 60, and two juxtaposed extension ears 21 each extending outward from the outer wall of the supporting column 24 and each formed with a plurality of locking ribs 23, and a pivot base 10 comprising a rotary block 12 rotatably mounted between the two extension ears 21 and including two sides each containing a plurality of locking indents 14 each receiving one of the plurality of locking ribs 23 of each of the two extension ears 21, and a supporting tube 11 fixedly mounted on or extending from the rotary block 12 for receiving the shank 61 of the sunshade umbrella 60 therein.

The plurality of locking ribs 23 are radially arranged with each other, and the plurality of locking indents 14 are radially arranged with each other. Each of the two extension ears 21 transversely contains a first center hole 22, and the rotary block 12 transversely contains a second center hole 13 aligning with the first center hole 22 of each of the two extension ears 21.

The coupling device further comprises a positioning bolt 42 including a smooth portion 421 extending through the first center hole 22 of each of the two extension ears 21 and through the second center hole 13 of the rotary block 12 and including a threaded portion 422 exposed outward of one of the two extension ears 21, and a wing nut 40 screwed onto the threaded portion 422 of the positioning bolt 42 and abutting one extension ear 21. The wing nut 40 includes two hooks 41 each extending outward for hanging a small article such as a bag, a towel and the like.

Figure 3:
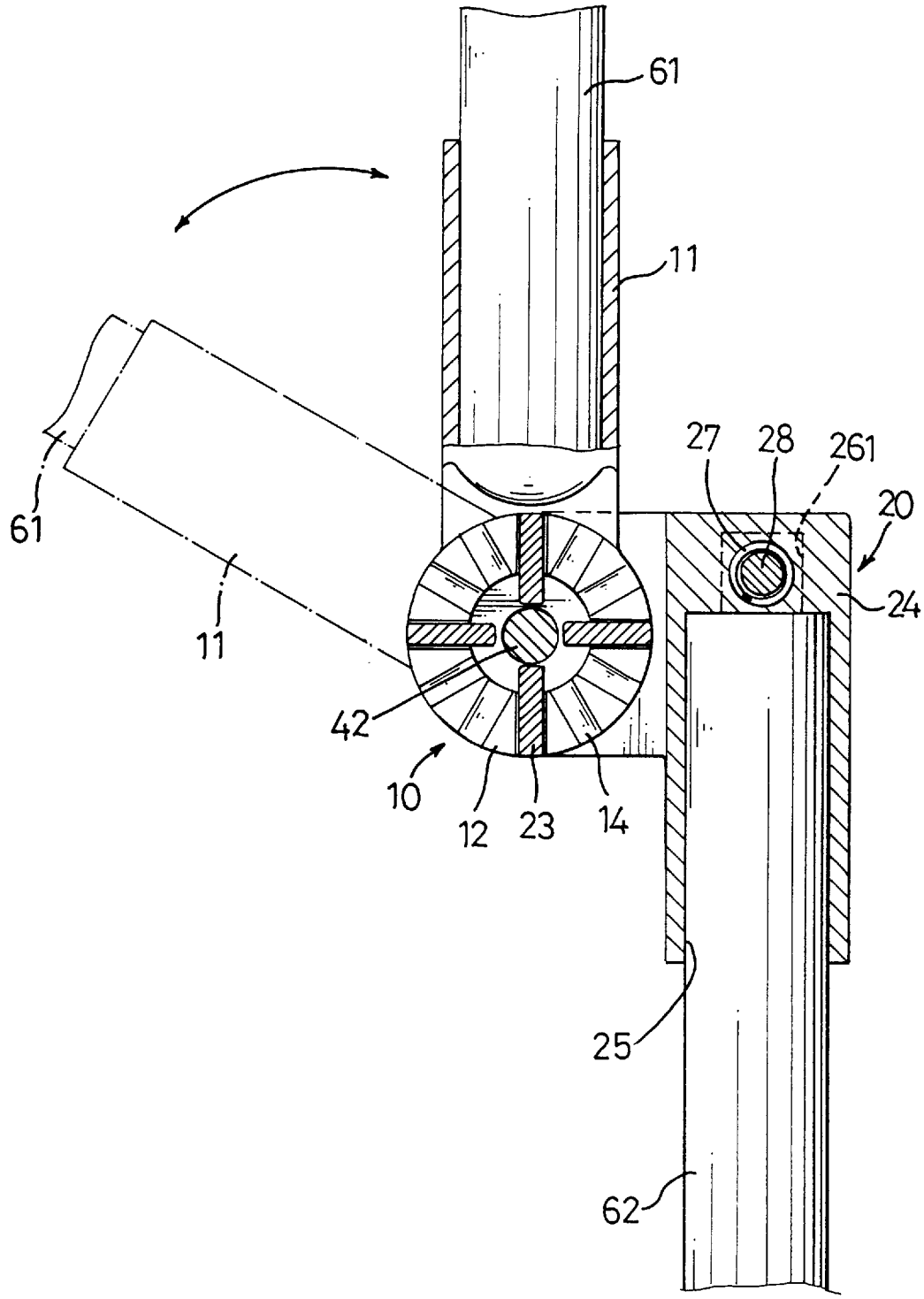
FIG. 3 is a front plan cross-sectional view of the coupling device as shown in FIG. 1.
Figure 4:
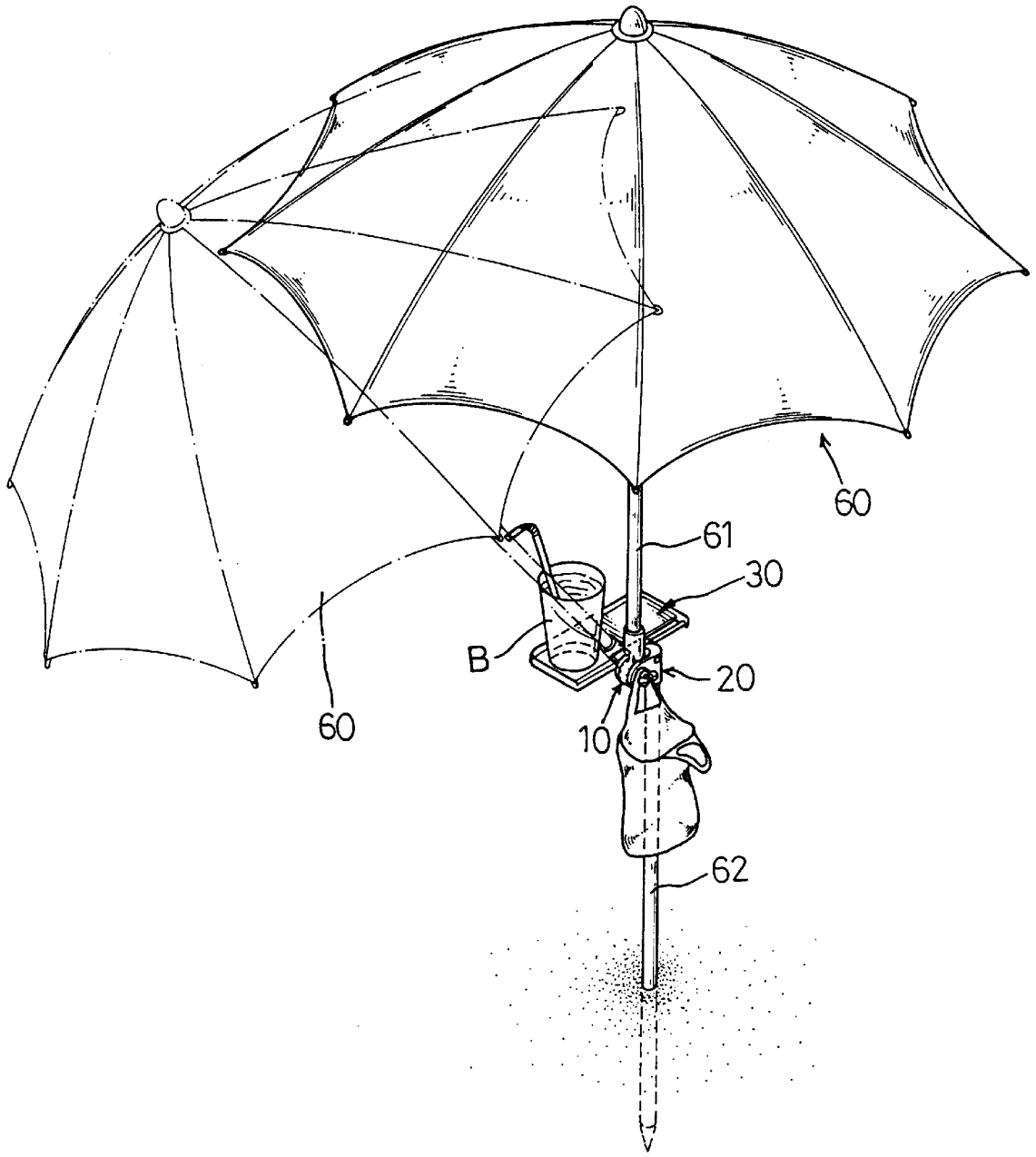
FIG. 4 is an operational view of the coupling device as shown in FIG. 1.

In operation, the wing nut 40 can be slightly unscrewed from the threaded portion 422 of the positioning bolt 42, thereby releasing the close fit between the rotary block 12 and each of the two extension ears 21 such that the rotary block 12 together with the supporting tube 11 can be pivoted relative to the supporting column 24 as shown in FIGS. 3 and 4, thereby adjusting the inclined angle of the sunshade umbrella 60 to the angle desired. The rotary block 12 can be securely clamped between the two extension ears 21 by means of the engagement between the locking ribs 23 and the locking indents 14.

Figure 1:
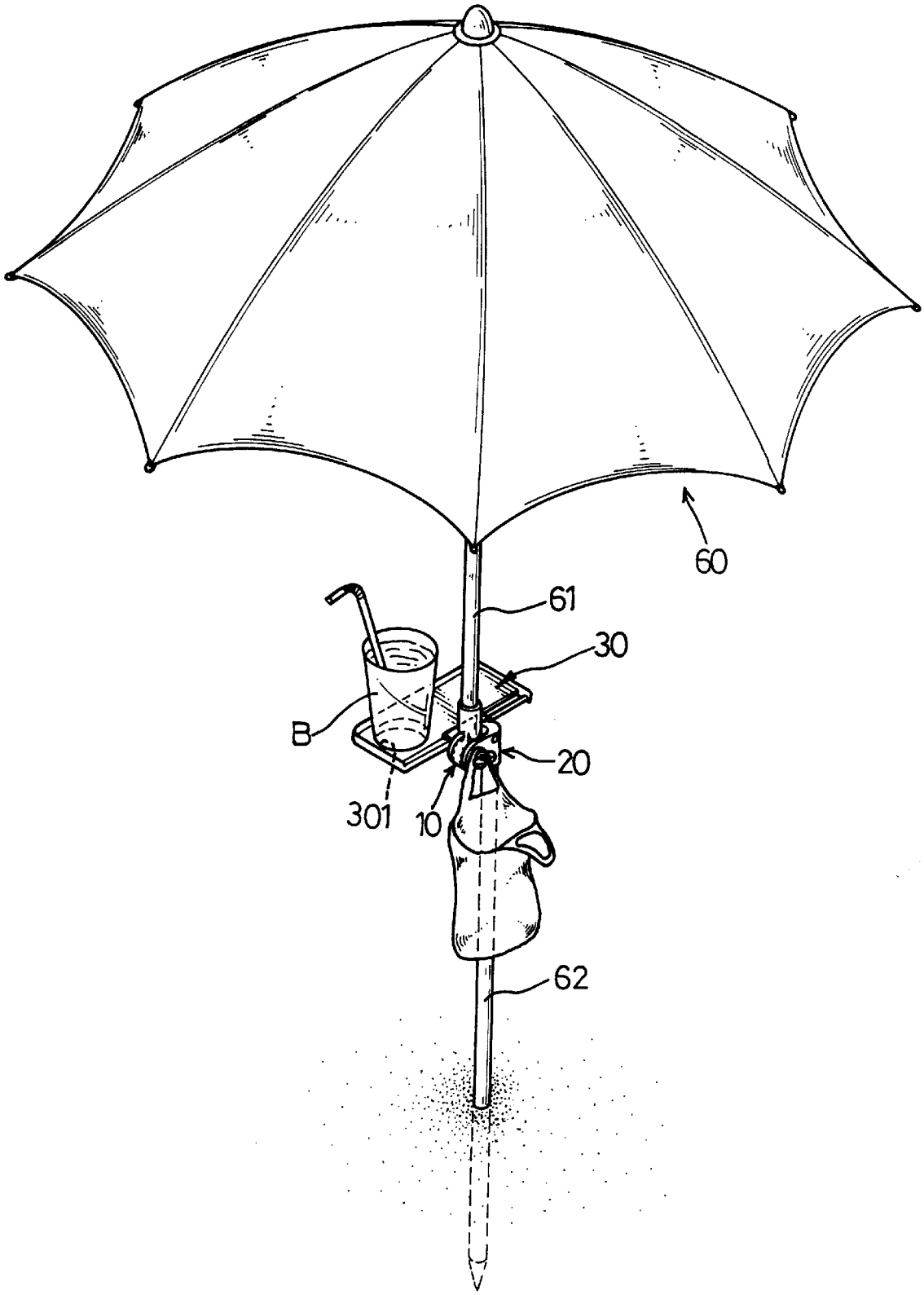
FIG. 1 is a perspective view of a coupling device for a sunshade umbrella in accordance with the present invention.
Figure 2:
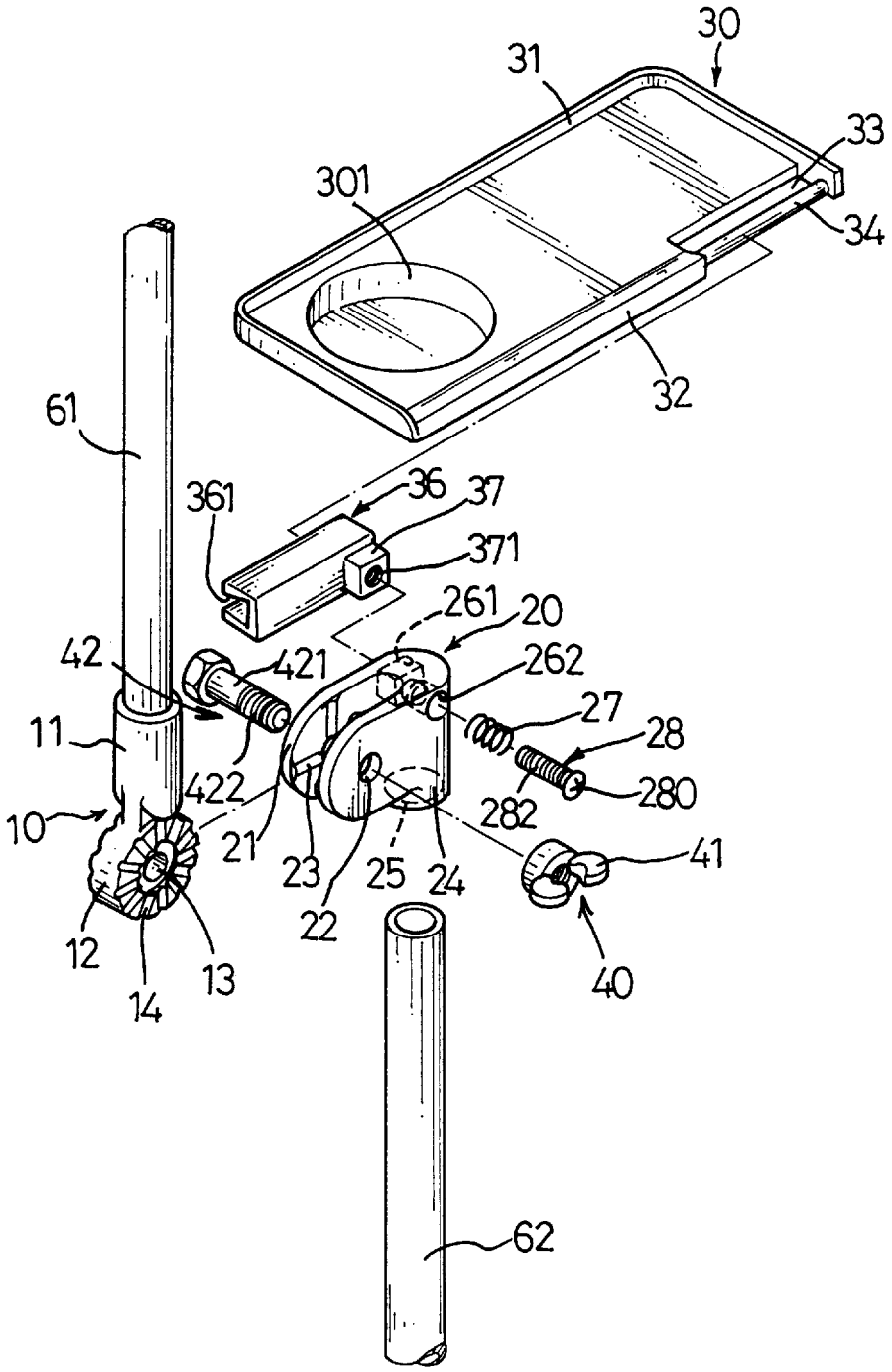
FIG. 2 is an exploded view of the coupling device as shown in FIG. 1.
Figure 5:
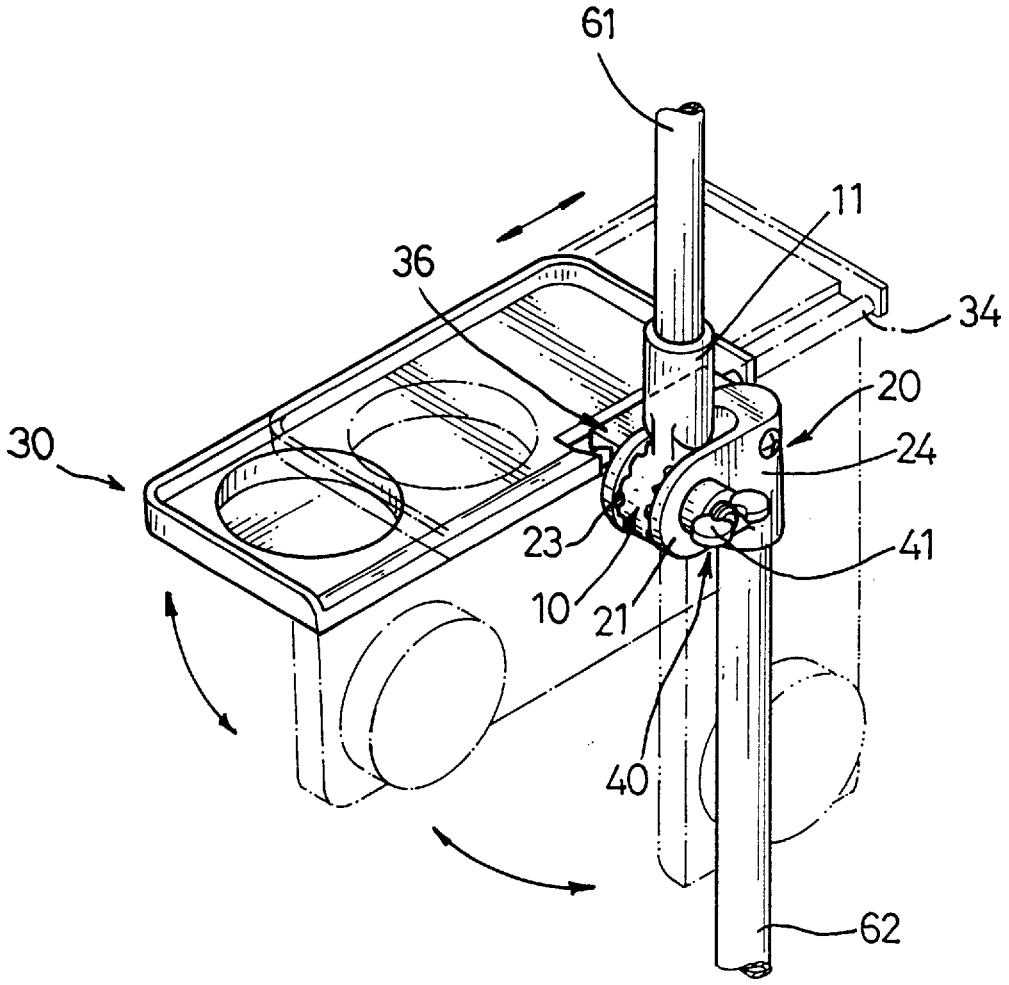
FIG. 5 is an operational view of the coupling device as shown in FIG. 1.
Figure 6:
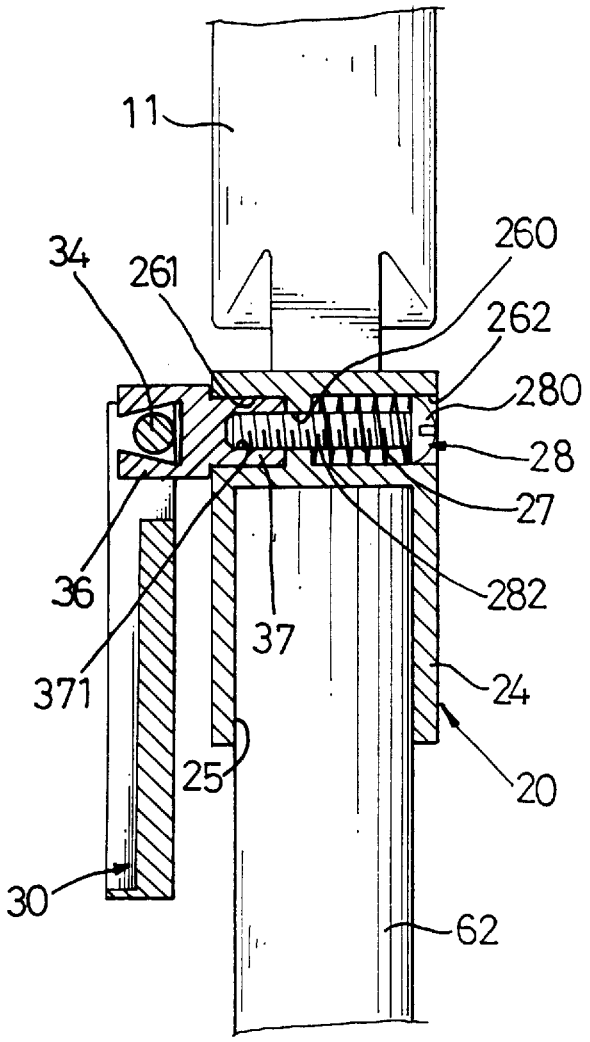
FIG. 6 is a side plan cross-sectional view of the coupling device as shown in FIG. 1.
Figure 7:
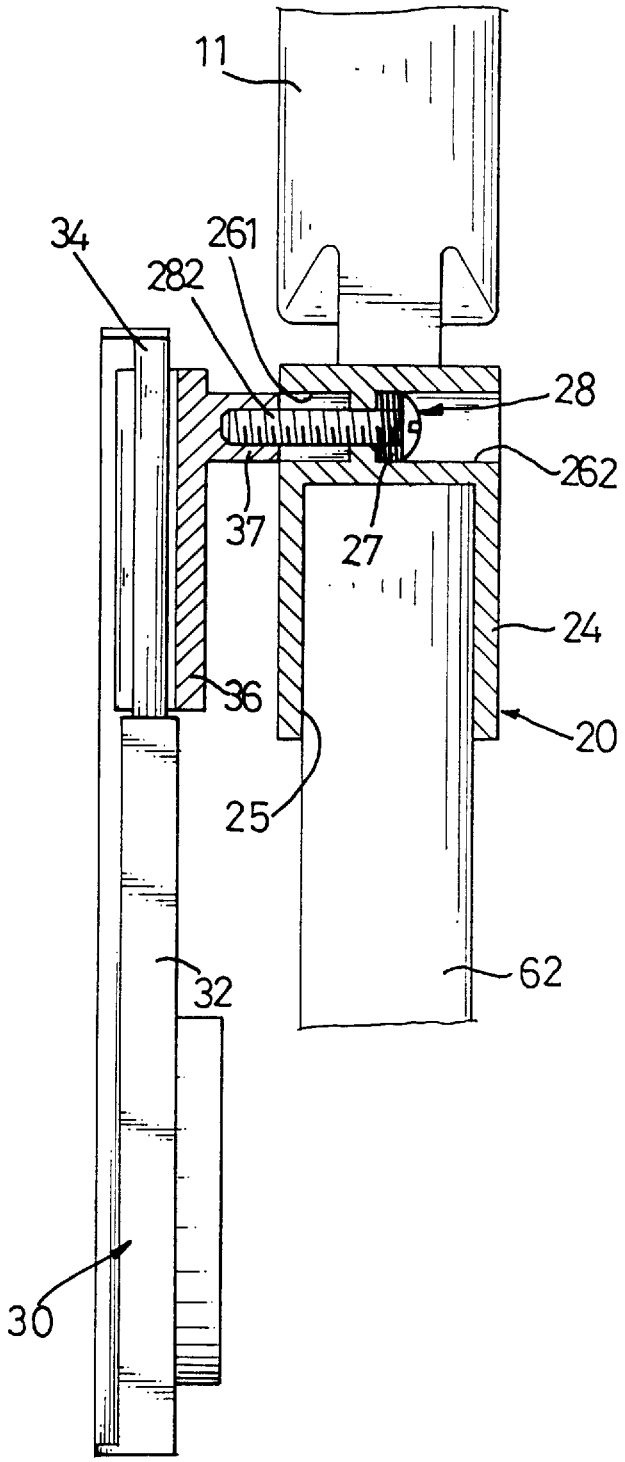
FIG. 7 is an operational view of the coupling device as shown in FIG. 6.

Referring now to FIGS. 5–7 with reference to FIGS. 1 and 2, the first end portion of the supporting column 24 includes a first side transversely containing a tetragonal locking recess 261, a mediate portion transversely containing a bore 260 connecting to the locking recess 261, and a second side transversely containing a receiving recess 262 connecting to the bore 260. The bore 260 has a dimension smaller than that of the locking recess 261 and smaller than that of the receiving recess 262.

The coupling device further comprises a suspension base 36 secured on the supporting column 24 and formed with a tetragonal plug 37 detachably received in the tetragonal locking recess 261 and transversely containing a threaded bore 371, a positioning screw 28 slidably mounted in the supporting column 24 and including a head 280 received in the receiving recess 262 and a threaded shank 282 extending through the bore 260 and screwed into the threaded bore 371 of the plug 37, and a biasing member 27 received in the receiving recess 262 and pressing the head 280 of the positioning screw 28.

The suspension base 36 longitudinally contains a guiding groove 361, and the coupling device further comprises a supporting rack 30 including a first side formed with a guiding track 32 slidably received in the guiding groove 361 and a second side. The guiding groove 361 has a dovetail shape, and the guiding track 32 has a wedge shape such that the guiding track 32 can be limited in the guiding groove 361.

The first side of the supporting rack 30 includes a recessed end portion containing an opening 33 therein, and a pivot shaft 34 fixedly received in the opening 33 of the recessed end portion and aligning with the guiding track 32. The supporting rack 30 further contains an object receiving socket 301 therein for receiving such as a beverage container B and includes a flange 31 formed on the periphery thereof.

In operation, the guiding track 32 can be moved in the guiding groove 361 such that the supporting rack 30 can be displaced relative to the suspension base 36 to a position where the guiding track 32 is detached from the guiding groove 361 while the pivot shaft 34 can be received into the guiding groove 36 such that the supporting rack 30 can be pivoted relative to the suspension base 36 to a position as shown in FIGS. 5 and 6.

The suspension base 36 can then be drawn to move outward relative to the supporting column 24 of the coupling base 20 from the position as shown in FIG. 6 to the position as shown in FIG. 7, thereby detaching the plug 37 from the locking recess 261 such that the suspension base 36 together with the supporting rack 30 can be pivoted relative to the supporting column 24 to the position as shown in phantom lines in FIG. 7, thereby folding the coupling device.

The rotary block 12 together with the supporting tube 11 can then be pivoted relative to the supporting column 24 by means of unscrewing the wing nut 40 from the positioning bolt 42, thereby pivoting the shank 61 to be juxtaposed to the supporting post 62, thereby collapsing the sunshade umbrella 60.

It should be clear to those skilled in the art that further embodiments may be made without departing from the scope and spirit of the present invention.

What is claimed is:

1. A coupling device for a collapsible sunshade umbrella comprising:

a coupling base (20) comprising a supporting column (24) including a first end portion and a second end portion containing an insertion socket (25) therein, and two juxtaposed extension ears (21) each extending outward from the outer wall of said supporting column (24) and each formed with a plurality of locking ribs (23); and a pivot base (10) comprising a rotary block (12) rotatably mounted between said two extension ears (21) and including two sides each containing a plurality of locking indents (14) each receiving one of said plurality of locking ribs (23) of each of said two extension ears (21), and a supporting tube (11) fixedly mounted on said rotary block (12).

2. The coupling device in accordance with claim 1, wherein said plurality of locking ribs (23) are radially arranged with each other.

3. The coupling device in accordance with claim 1, wherein said plurality of locking indents (14) are radially arranged with each other.

4. The coupling device in accordance with claim 1, wherein each of said two extension ears (21) transversely contains a first center hole (22), and said rotary block (12) transversely contains a second center hole (13) aligning with said first center hole (22) of each of said two extension ears (21), and said coupling device further comprises a positioning bolt (42) including a smooth portion (421) extending through said first center hole (22) of each of said two extension ears (21) and through said second center hole (13) of said rotary block (12) and including a threaded portion (422) exposing outward of one of said two extension ears (21), and a wing nut (40) screwed onto said threaded portion (422) of said positioning bolt (42) and abutting said one extension ear (21).

5. The coupling device in accordance with claim 1, wherein said first end portion of said supporting column (24) includes a first side transversely containing a tetragonal locking recess (261), a mediate portion transversely containing a bore (260) connecting to said locking recess (261), and a second side transversely containing a receiving recess (262) connecting to said bore (260), and said coupling device further comprises a suspension base (36) secured on said supporting column (24) and formed with a tetragonal plug (37) detachably received in said tetragonal locking recess (261) and transversely containing a threaded bore (371), a positioning screw (28) slidably mounted in said supporting column (24) and including a head (280) received in said receiving recess (262) and a threaded shank (282) extending through said bore (260) and screwed into said threaded bore (371) of said plug (37), and a biasing member (27) received in said receiving recess (262) and pressing said head (280) of said positioning screw (28).

6. The coupling device in accordance with clam 5, wherein said bore (260) has a dimension smaller than that of said locking recess (261).

7. The coupling device in accordance with claim 5, wherein said bore (260) has a dimension smaller than that of said receiving recess (262).

8. The coupling device in accordance with claim 5, wherein said suspension base (36) longitudinally contains a guiding groove (361), and said coupling device further comprises a supporting rack (30) including a first side formed with a guiding track (32) slidably received in said guiding groove (361) and a second side.

9. The coupling device in accordance with claim 8, wherein said guiding groove (361) has a dovetail shape, and said guiding track (32) has a wedge shape.

10. The coupling device in accordance with claim 8, wherein said first side of said supporting rack (30) includes a recessed end portion containing an opening (33) therein, and said supporting rack (30) further comprises a pivot shaft (34) fixedly received in said opening (33) of said recessed end portion and aligning with said guiding track (32).

11. The coupling device in accordance with claim 8, wherein said supporting rack (30) contains an object receiving socket (301) therein.

* * * * *